US008506392B2

(12) United States Patent
Jaffe

(10) Patent No.: US 8,506,392 B2
(45) Date of Patent: Aug. 13, 2013

(54) PROGRESSIVE WAGERING GAME WITH PERSONALIZED RESET-VALUE FEATURE FOR PLAYERS MEETING PREDETERMINED CRITERIA

(75) Inventor: Joel R. Jaffe, Glenview, IL (US)

(73) Assignee: WMS Gaming Inc., Waukegan, IL (US)

( * ) Notice: Subject to any disclaimer, the term of this patent is extended or adjusted under 35 U.S.C. 154(b) by 335 days.

(21) Appl. No.: 12/981,319

(22) Filed: Dec. 29, 2010

(65) Prior Publication Data

US 2011/0201416 A1 Aug. 18, 2011

Related U.S. Application Data

(60) Provisional application No. 61/305,877, filed on Feb. 18, 2010.

(51) Int. Cl.
*A63F 9/24* (2006.01)

(52) U.S. Cl.
USPC ..... 463/27; 463/25; 463/26; 463/28; 463/16; 463/20

(58) Field of Classification Search
USPC ..... 463/25–28, 16, 20, 42; 273/138.1, 273/139
See application file for complete search history.

(56) References Cited

U.S. PATENT DOCUMENTS

| | | | | |
|---|---|---|---|---|
| 4,837,728 | A * | 6/1989 | Barrie et al. | 463/27 |
| 5,885,158 | A | 3/1999 | Torango et al. | |
| 6,435,968 | B1 | 8/2002 | Torango | |
| 6,796,904 | B2 | 9/2004 | Yoseloff | |
| 6,890,259 | B2 | 5/2005 | Breckner et al. | |
| 6,966,834 | B1 * | 11/2005 | Johnson | 463/25 |
| 7,077,746 | B2 | 7/2006 | Torango | |
| 7,614,948 | B2 | 11/2009 | Saffari et al. | |
| 7,753,775 | B2 | 7/2010 | Yoshizawa | 463/20 |
| 2003/0003989 | A1 | 1/2003 | Johnson | |
| 2003/0032475 | A1 | 2/2003 | Yoseloff | |
| 2003/0069056 | A1 | 4/2003 | Cormack et al. | |

(Continued)

FOREIGN PATENT DOCUMENTS

| | | |
|---|---|---|
| WO | 2008060429 | 5/2008 |
| WO | 2008060442 | 5/2008 |

OTHER PUBLICATIONS

Third Party Submission dated Oct. 18, 2011, 3 pages.

(Continued)

*Primary Examiner* — David L Lewis
*Assistant Examiner* — Chase Leichliter
(74) *Attorney, Agent, or Firm* — Nixon Peabody LLP

(57) ABSTRACT

A gaming system includes a plurality of gaming terminals for playing wagering games that provide access to a progressive game having multiple progressive jackpots. Each progressive jackpot has a base reset value that increases in response to wager inputs. The gaming system comprises at least one controller operative to determine that a first player at a first gaming terminal has achieved a predetermined criteria, and to provide an award associated with one of the multiple progressive jackpots to a second player at a second gaming terminal who triggered the awarded jackpot. The controller maintains the value of the awarded progressive jackpot for the first player who achieved the predetermined criteria at the awarded value, but resets the awarded progressive jackpot to the lower base reset value for other gaming terminals. Thus, the first player benefits from a potentially higher jackpot award value due to achieving the predetermined criteria.

26 Claims, 11 Drawing Sheets

(56) References Cited

U.S. PATENT DOCUMENTS

| | | | | |
|---|---|---|---|---|
| 2003/0207705 | A1 | 11/2003 | Falciglia | |
| 2004/0092315 | A1 | 5/2004 | Boyd et al. | |
| 2004/0152511 | A1 | 8/2004 | Nicely et al. | |
| 2004/0235553 | A1 | 11/2004 | Iwamoto | 463/16 |
| 2004/0242320 | A1* | 12/2004 | Jackson | 463/26 |
| 2005/0064932 | A1 | 3/2005 | Cannon | 463/19 |
| 2006/0046820 | A1 | 3/2006 | Inamura | 463/16 |
| 2006/0247006 | A1 | 11/2006 | Inamura | 463/20 |
| 2007/0202944 | A1* | 8/2007 | Oomori | 463/27 |
| 2007/0218972 | A1* | 9/2007 | Gerson et al. | 463/20 |
| 2008/0153587 | A1* | 6/2008 | Yoshimura | 463/27 |
| 2009/0247302 | A1 | 10/2009 | Kelly et al. | |
| 2009/0264191 | A1 | 10/2009 | Roukis et al. | |
| 2009/0305776 | A1 | 12/2009 | Englman et al. | |
| 2010/0041459 | A1 | 2/2010 | Saffari et al. | |
| 2010/0062841 | A1 | 3/2010 | Englman et al. | |
| 2010/0087245 | A1 | 4/2010 | Johnson | |
| 2010/0093420 | A1 | 4/2010 | Wright et al. | |
| 2010/0197386 | A1* | 8/2010 | Lafky et al. | 463/27 |
| 2010/0261521 | A1 | 10/2010 | Oatman et al. | |

OTHER PUBLICATIONS

"Principles for the Functionality of Gaming Machine Monitoring and Control Systems." Australian government, 16 pages, Nov. 4, 2010. <http://www.olgr.qld.gov.au/resources/gamDocs/mon_sys/principlesForFunctionalityOfGamingMachineMonitoringAndControlSystemsVer2.pdf> Accessed Dec. 1, 2010.

* cited by examiner

| Multi-level Progressive Parameters | | | | |
|---|---|---|---|---|
| Level | Reset | Probability | Increment | Strike Price |
| 1 | $ 2,000.00 | 0.0005% | 1% | $ 4,000.00 |
| 2 | $ 500.00 | 0.002% | 1% | $ 1,000.00 |
| 3 | $ 100.00 | 0.01% | 1% | $ 200.00 |
| 4 | $ 20.00 | 0.05% | 2% | $ 60.00 |
| 5 | $ 10.00 | 0.1% | 3% | $ 40.00 |
| EV | 5.00% | | 8.00% | |

| | |
|---|---|
| Base Game EV | 75.00% |
| Progressive Game Reset EV | 5.00% |
| Progressive Game Average Increment EV | 8.00% |
| Progressive Game Average Total EV | 13.00% |
| Minimum Wagering Game EV | 80.00% |
| Average Wagering Game EV | 88.00% |

FIG. 7

| Multi-level Progressive Parameters | | | | | Padded Reset Values | |
|---|---|---|---|---|---|---|
| Level | Reset | Probability | Increment | Strike Price | Reset | Additional EV |
| 1 | $ 2,000.00 | 0.0005% | 1% | $ 4,000.00 | $3000.00 | 0.50% |
| 2 | $ 500.00 | 0.002% | 1% | $ 1,000.00 | $ 750.00 | 0.50% |
| 3 | $ 100.00 | 0.01% | 1% | $ 200.00 | $ 150.00 | 0.50% |
| 4 | $ 20.00 | 0.05% | 2% | $ 60.00 | $ 30.00 | 0.50% |
| 5 | $ 10.00 | 0.1% | 3% | $ 40.00 | $ 20.00 | 1.00% |
| EV | 5.00% | | 8.00% | | | 3.00% |

| | |
|---|---|
| Base Game EV | 75.00% |
| Progressive Game Reset EV | 5.00% |
| Progressive Game Padded Reset EV | 3.00% |
| Progressive Game Average Increment EV | 8.00% |
| Progressive Game Average Total EV | 13.00% |
| Minimum Wagering Game EV | ≥ 83.00% |
| Average Wagering Game EV | 88.00% |

FIG. 8A

| State 1 | | | |
|---|---|---|---|
| Level | Value | Probability | EV |
| 1 | $ 2,277.00 | 0.0005% | 1.14% |
| 2 | $ 963.59 | 0.002% | 1.93% |
| 3 | $ 117.70 | 0.01% | 1.18% |
| 4 | $ 52.10 | 0.05% | 2.61% |
| 5 | $ 36.57 | 0.1% | 3.66% |
| Total Game EV | | | 85.52% |

FIG. 8B

| State 2a | | | |
|---|---|---|---|
| Level | Value | Probability | EV |
| 1 | $ 2,277.00 | 0.0005% | 1.14% |
| 2 | $ 963.59 | 0.002% | 1.93% |
| 3 | $ 117.70 | 0.01% | 1.18% |
| 4 | $ 52.10 | 0.05% | 2.61% |
| 5 | $ 10.00 | 0.1% | 1.00% |
| Total Game EV | | | 82.86% |

| State 2b | | | |
|---|---|---|---|
| Level | Value | Probability | EV |
| 1 | $ 2,277.00 | 0.0005% | 1.14% |
| 2 | $ 963.59 | 0.002% | 1.93% |
| 3 | $ 117.70 | 0.01% | 1.18% |
| 4 | $ 52.10 | 0.05% | 2.61% |
| 5 | $ 20.00 | 0.1% | 2.00% |
| Total Game EV | | | 83.86% |

FIG. 8C

| State 3a | | | |
|---|---|---|---|
| Level | Value | Probability | EV |
| 1 | $ 2,277.00 | 0.0005% | 1.14% |
| 2 | $ 963.59 | 0.002% | 1.93% |
| 3 | $ 117.70 | 0.01% | 1.18% |
| 4 | $ 20.00 | 0.05% | 1.00% |
| 5 | $ 20.00 | 0.1% | 2.00% |
| Total Game EV | | | 82.25% |

| State 3b | | | |
|---|---|---|---|
| Level | Value | Probability | EV |
| 1 | $ 2,277.00 | 0.0005% | 1.14% |
| 2 | $ 963.59 | 0.002% | 1.93% |
| 3 | $ 117.70 | 0.01% | 1.18% |
| 4 | $ 30.00 | 0.05% | 1.50% |
| 5 | $ 20.00 | 0.1% | 2.00% |
| Total Game EV | | | 82.75% |

| State 3c | | | |
|---|---|---|---|
| Level | Value | Probability | EV |
| 1 | $ 3,000.00 | 0.0005% | 1.50% |
| 2 | $ 963.59 | 0.002% | 1.93% |
| 3 | $ 117.70 | 0.01% | 1.18% |
| 4 | $ 30.00 | 0.05% | 1.50% |
| 5 | $ 20.00 | 0.1% | 2.00% |
| Total Game EV | | | 83.11% |

FIG. 8D

| Multi-level Progressive Parameters | | | | |
|---|---|---|---|---|
| Level | Reset | Probability | Increment | Strike Price |
| 1 | $ 2,000.00 | 0.0005% | 1% | $ 4,000.00 |
| 2 | $ 500.00 | 0.002% | 1% | $ 1,000.00 |
| 3 | $ 100.00 | 0.01% | 1% | $ 200.00 |
| 4 | $ 20.00 | 0.05% | 2% | $ 60.00 |
| 5 | $ 10.00 | 0.1% | 3% | $ 40.00 |
| EV | 5.00% | | 8.00% | |

| | |
|---|---|
| Base Game EV | 75.00% |
| Progressive Game Reset EV | 5.00% |
| Progressive Game Padded Reset EV | TBD% |
| Progressive Game Average Increment EV | 8.00% |
| Progressive Game Average Total EV | 13.00% |
| Minimum Wagering Game EV | 83.00% |
| Average Wagering Game EV | 88.00% |

FIG.9A

| State 1 | | | |
|---|---|---|---|
| Level | Value | Probability | EV |
| 1 | $ 2,277.00 | 0.0005% | 1.14% |
| 2 | $ 963.59 | 0.002% | 1.93% |
| 3 | $ 117.70 | 0.01% | 1.18% |
| 4 | $ 52.10 | 0.05% | 2.61% |
| 5 | $ 36.57 | 0.1% | 3.66% |
| Total Game EV | | | 85.52% |

FIG. 9B

| State 2a | | | |
|---|---|---|---|
| Level | Value | Probability | EV |
| 1 | $ 2,277.00 | 0.0005% | 1.14% |
| 2 | $ 963.59 | 0.002% | 1.93% |
| 3 | $ 117.70 | 0.01% | 1.18% |
| 4 | $ 52.10 | 0.05% | 2.61% |
| 5 | $ 10.00 | 0.1% | 1.00% |
| Total Game EV | | | 82.86% |

| State 2b | | | |
|---|---|---|---|
| Level | Value | Probability | EV |
| 1 | $ 2,277.00 | 0.0005% | 1.14% |
| 2 | $ 963.59 | 0.002% | 1.93% |
| 3 | $ 117.70 | 0.01% | 1.18% |
| 4 | $ 52.10 | 0.05% | 2.61% |
| 5 | $ 11.53 | 0.1% | 1.15% |
| Total Game EV | | | 83.01% |

FIG. 9C

PROGRESSIVE WAGERING GAME WITH PERSONALIZED RESET-VALUE FEATURE FOR PLAYERS MEETING PREDETERMINED CRITERIA

REFERENCE TO RELATED APPLICATIONS

This application is related to and claims priority to U.S. Provisional Patent Application Ser. No. 61/305,877, filed Feb. 18, 2010, and titled "Progressive Wagering Game With Personalized Reset-Value Feature For Players Meeting Predetermined Criteria," which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present disclosure relates generally to a gaming apparatus and methods for playing wagering games, and more particularly to a progressive bonus feature that includes multiple awards at different percentages of a progressive jackpot award amount that are awarded without resetting the progressive jackpot award amount.

BACKGROUND

Gaming terminals, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

In order to attract players and achieve player loyalty to different games, game designers seek to make games interesting to the player. There are therefore continual challenges to develop different attractive features to a player in wagering games.

One concept that has been successfully employed to enhance the entertainment value of a game is that of a "secondary" or "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

Another concept that has been employed is the use of a progressive game having one or more progressive jackpots. In the gaming industry, a "progressive" game involves collecting coin-in data (i.e., wager inputs) from participating gaming device(s) (e.g., slot machines), contributing a percentage of that coin-in data to the jackpot amount(s) for the one or more progressive jackpots, and awarding one or more of the progressive jackpot(s) to a player upon the occurrence of certain jackpot-triggering events. A jackpot-triggering event may occur when a "progressive winning position" is achieved at a participating gaming device. If the gaming device is a slot machine, a progressive winning position may, for example, correspond to alignment of progressive jackpot reel symbols along a certain payline. Or, the jackpot-triggering event may be a "mystery" award to a player based on a random number generator that is unrelated to the outcome of the basic game.

The initial amount of each progressive jackpot is a predetermined minimum amount, usually referred to a "reset" value. The jackpot amount, however, progressively increases as players continue to play the gaming machine without winning the progressive jackpot. Further, when several gaming machines are linked together such that several players at several gaming machines compete for the same jackpot, the jackpot progressively increases at a much faster rate, which leads to further player excitement. Many players are attracted to wagering games that have progressive jackpots that increase at a rapid rate.

In existing progressive jackpots, once the progressive jackpot is awarded to a first player, the jackpot amount is reset to the predetermined minimum amount. This predetermined minimum amount is not as attractive to other players who preferred the higher jackpot amount prior to the jackpot being triggered by the first player. Some players lose interest in the wagering game after one or more of the progressive jackpots have been awarded to other players.

Another problem that may occur when one or more of the progressive jackpots are triggered and reset to the base value relates to jurisdictional requirements. Most jurisdictions require the wagering game to have a minimum expected value (EV). The EV of the wagering game is equal to the EV of the basic game (which is typically fixed) plus the EV of the progressive game (which fluctuates based on the jackpots' award values). If the EV of the basic game is lower than the minimum jurisdictional EV, then under certain conditions (e.g., when several progressive jackpots are awarded and reset to the base reset value within a short period of time), the progressive game's EV can be reduced, causing the total EV for the wagering game to fall below the minimum jurisdictional EV.

Thus, what is needed is a wagering system that allows players to remain interested in the wagering game after the progressive jackpot has been awarded to another player. Further, what is needed is a wagering system that guarantees that the overall EV of the wagering game is at or above the minimum jurisdictional EV.

SUMMARY

The present disclosure relates to a control module for a gaming system that includes a plurality of gaming terminals for playing wagering games. The wagering games provide access to a progressive game having multiple progressive jackpots. Each of the multiple progressive jackpots have a base reset value and increase from the base reset value in response to wager inputs at the plurality of gaming terminals.

Each of the gaming terminals includes a display for displaying the current values of the multiple progressive jackpots for a gaming system. The gaming-system control module comprises at least one controller operative to determine that a first player at a first one of the plurality of gaming terminals has achieved a predetermined criteria while playing the wagering game. The at least one controller is further operative to provide an award associated with one of the multiple progressive jackpots to a second player at a second one of the plurality of gaming terminals who triggered the awarded one of the multiple progressive jackpots. The at least one controller is further operative to, after providing the award, maintain the value of the awarded one of the multiple progressive jackpots for the first player who has achieved the predetermined criteria and reset the awarded one of the multiple progressive jackpots to the base reset value for other ones of the plurality of gaming terminals.

The present disclosure also involves a method of conducting a wagering game on a gaming system. The wagering game includes a base game and a progressive game having multiple progressive jackpots. The method comprises receiving wager inputs from players playing the wagering game and allocating portions of the wager inputs to the progressive game for increasing an award value for each of the multiple jackpots. The method also comprises determining that a first player has achieved a predetermined criteria while playing the wagering game and providing an award value of a first one of the multiple progressive jackpots to a second player. The method further comprises, after the determining and the providing, resetting the first one of the multiple progressive jackpots to a base reset value for players other than the first player, and after the determining and the providing, receiving additional wager inputs from players and allocating portions of the additional wager inputs to the progressive game to increment the award values for the multiple jackpots. The method comprises, after the determining and the providing, maintaining, for the first player, the first one of the multiple progressive jackpots at the award value provided to the second player such that the first player has the opportunity for a higher award relative to other players if the first player triggers the first one of the multiple progressive jackpots.

The present disclosure also entails a method of conducting a wagering game on a gaming system, wherein the wagering game provide access to a progressive game having at least a first progressive jackpot. The method comprises receiving, from wager input devices, wager inputs from players playing the wagering game, and incrementing, via the use of at least one controller, the first progressive jackpot to an award value by use of a portion of the wager inputs. The method further includes determining, via the use of the at least one controller, that a first player has achieved a predetermined criteria while playing the wagering game, and awarding the award value of the first progressive jackpot to a second player in response to the second player triggering the first progressive jackpot. The method further includes, after the determining and the awarding, resetting, via the use of the at least one controller, the first progressive jackpot to a base reset value for players other than the first player and maintaining the first progressive jackpot for the first player at the award value awarded to the second player. The method also includes after the determining, the awarding, the resetting, and the maintaining, (i) receiving, via the wager input devices, additional wager inputs from players and incrementing the first progressive jackpot from the base reset value to a new award value; (ii) determining, via the use of the at least one controller, that a third player has achieved the predetermined criteria while playing the wagering game; (iii) awarding, via the use of the at least one controller, the new award value of the first progressive jackpot to a fourth player in response to the fourth player triggering the first progressive jackpot; and (iv) after the awarding the new award value to the fourth player, resetting, via the use of the at least one controller, the first progressive jackpot to the base reset value for players other than the first player and the third player and maintaining the first progressive jackpot for the third player at the new award value awarded to the fourth player such that the first player and the third player can be awarded different award values relative to other players in response to triggering the first progressive jackpot.

Additional aspects of the disclosure will be apparent to those of ordinary skill in the art in view of the detailed description of various embodiments, which is made with reference to the drawings, a brief description of which is provided below.

BRIEF DESCRIPTION OF THE DRAWINGS

FIG. 7 is a table illustrating how a multiple-level progressive game may cause the wagering game to fall outside jurisdiction limits when certain conditions occur.

FIGS. 8A-8D are tables illustrating how a multiple-level progressive game may cause the wagering game to fall outside jurisdiction limits when certain conditions occur, and the use of a padded reset feature to ensure the wagering game falls within the jurisdiction limits.

FIGS. 9A-9C are tables illustrating how a multiple-level progressive game may cause the wagering game to fall outside jurisdiction limits when certain conditions occur, and the use of an alternative padded reset feature to ensure the wagering game falls within the jurisdiction limits.

Figure 1:
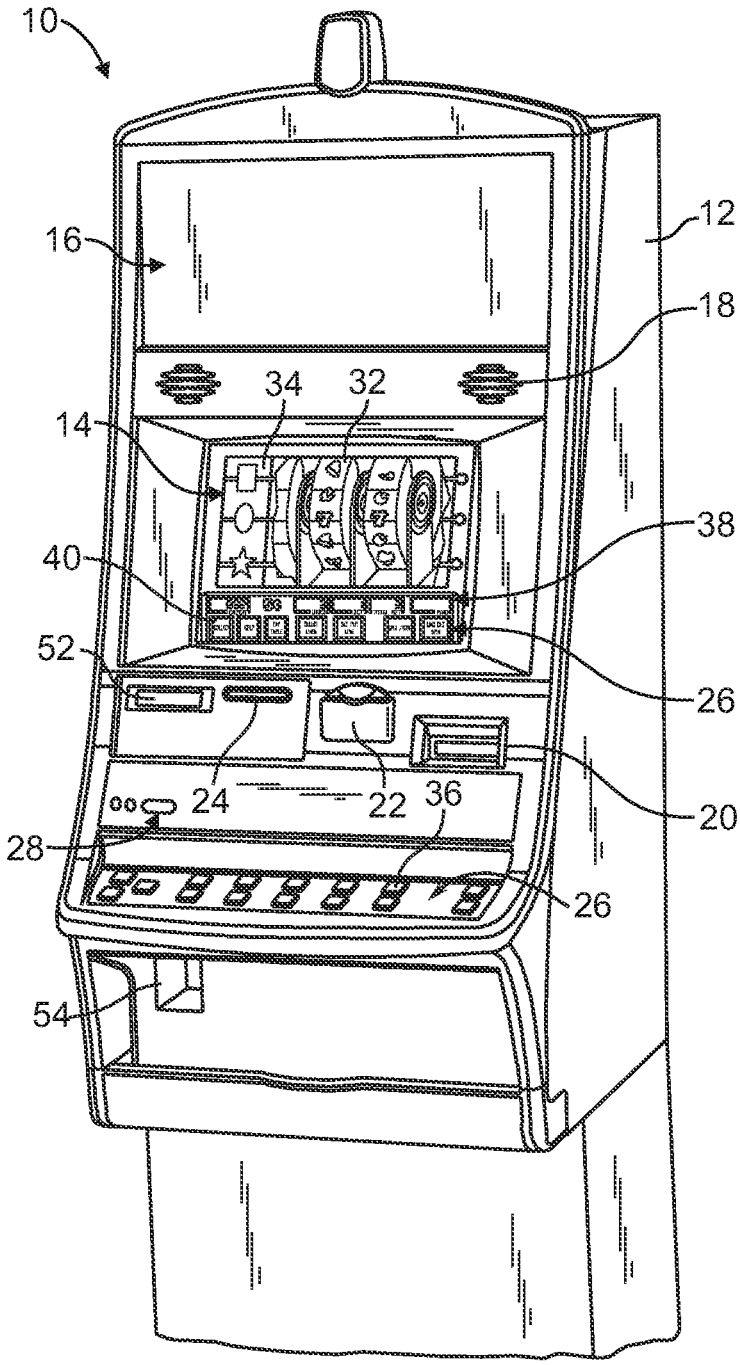
FIG. 1 (Prior Art)
FIG. 1 is a perspective view of a free-standing gaming terminal.

While the disclosure is susceptible to various modifications and alternative forms, specific embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the disclosure as defined by the appended claims.

DETAILED DESCRIPTION

While this disclosure is susceptible of embodiment in many different forms, there is shown in the drawings and will herein be described in detail preferred embodiments of the disclosure with the understanding that the present disclosure is to be considered as an exemplification of the principles of the disclosure and is not intended to limit the broad aspect of the disclosure to the embodiments illustrated.

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, the gaming terminal 10 may be an electromechanical gaming terminal configured to play mechanical slots, or it may be an electronic gaming terminal configured to play a video casino game, such as slots, keno, poker, blackjack, roulette, craps, etc. It should be understood that although the gaming terminal 10 is shown as a free-standing terminal of the upright type, it may take on a wide variety of other forms such as a free-standing terminal of the slant-top type, a portable or handheld device primarily used for gaming, a mobile telecommunications device such as a mobile telephone or personal digital assistant (PDA), a counter-top or bar-top gaming terminal, or other personal electronic device such as a portable television, MP3 player, entertainment device, etc.

The illustrated gaming terminal 10 comprises a cabinet or housing 12. For output devices, the gaming terminal 10 may include a primary display area 14, a secondary display area 16, and one or more audio speakers 18. The primary display area 14 and/or secondary display area 16 may display information associated with wagering games, non-wagering games, community games, progressive games, advertisements, services, premium entertainment, text messaging, e-mails, alerts or announcements, broadcast information, subscription information, etc. For input devices, the gaming terminal 10 may include a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements may exist and may be used in any number of combinations to create various forms of a gaming terminal.

The primary display area 14 may include a mechanical-reel display, a video display, or a combination thereof in which a transmissive video display in front of the mechanical-reel display portrays a video image superimposed over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10. The primary display area 14 may include one or more paylines 30 (see FIG. 3) extending along a portion thereof. In the illustrated embodiment, the primary display area 14 comprises a plurality of mechanical reels 32 and a video display 34 such as a transmissive display (or a reflected image arrangement in other embodiments) in front of the mechanical reels 32. If the wagering game conducted via the gaming terminal 10 relies upon the video display 34 only and not the mechanical reels 32, the mechanical reels 32 may be removed from the interior of the terminal and the video display 34 may be of a non-transmissive type. Similarly, if the wagering game conducted via the gaming terminal 10 relies upon the mechanical reels 32 but not the video display 34, the video display 34 may be replaced with a conventional glass panel. Further, the underlying mechanical-reel display may be replaced with a video display such that the primary display area 14 includes layered video displays, or may be replaced with another mechanical or physical member such as a mechanical wheel (e.g., a roulette game), dice, a pachinko board, or a diorama presenting a three-dimensional model of a game environment.

Video images in the primary display area 14 and/or the secondary display area 16 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 26 may include a plurality of buttons 36 on a button panel and/or a touch screen 38 mounted over the primary display area 14 and/or the secondary display area 16 and having one or more soft touch keys 40. The player-input devices 26 may further comprise technologies that do not rely upon touching the gaming terminal, such as speech-recognition technology, gesture-sensing technology, eye-tracking technology, etc.

The information reader 24 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 24 for accessing an account associated with cashless gaming, player tracking, game customization, saved-game state, data transfer, and casino services as more fully disclosed in U.S. Patent Publication No. 2003/0045354 entitled "Portable Data Unit for Communicating With Gaming Machine Over Wireless Link," which is incorporated herein by reference in its entirety. The account may be stored at an external system 46 (see FIG. 2) as more fully disclosed in U.S. Pat. No. 6,280,328 to Holch et al. entitled "Cashless Computerized Video Game System and Method," which is incorporated herein by referenced in its entirety, or directly on the portable medium. To enhance security, the individual carrying the portable medium may be required to enter a secondary independent authenticator (e.g., password, PIN number, biometric, etc.) to access their account.

Figure 2:
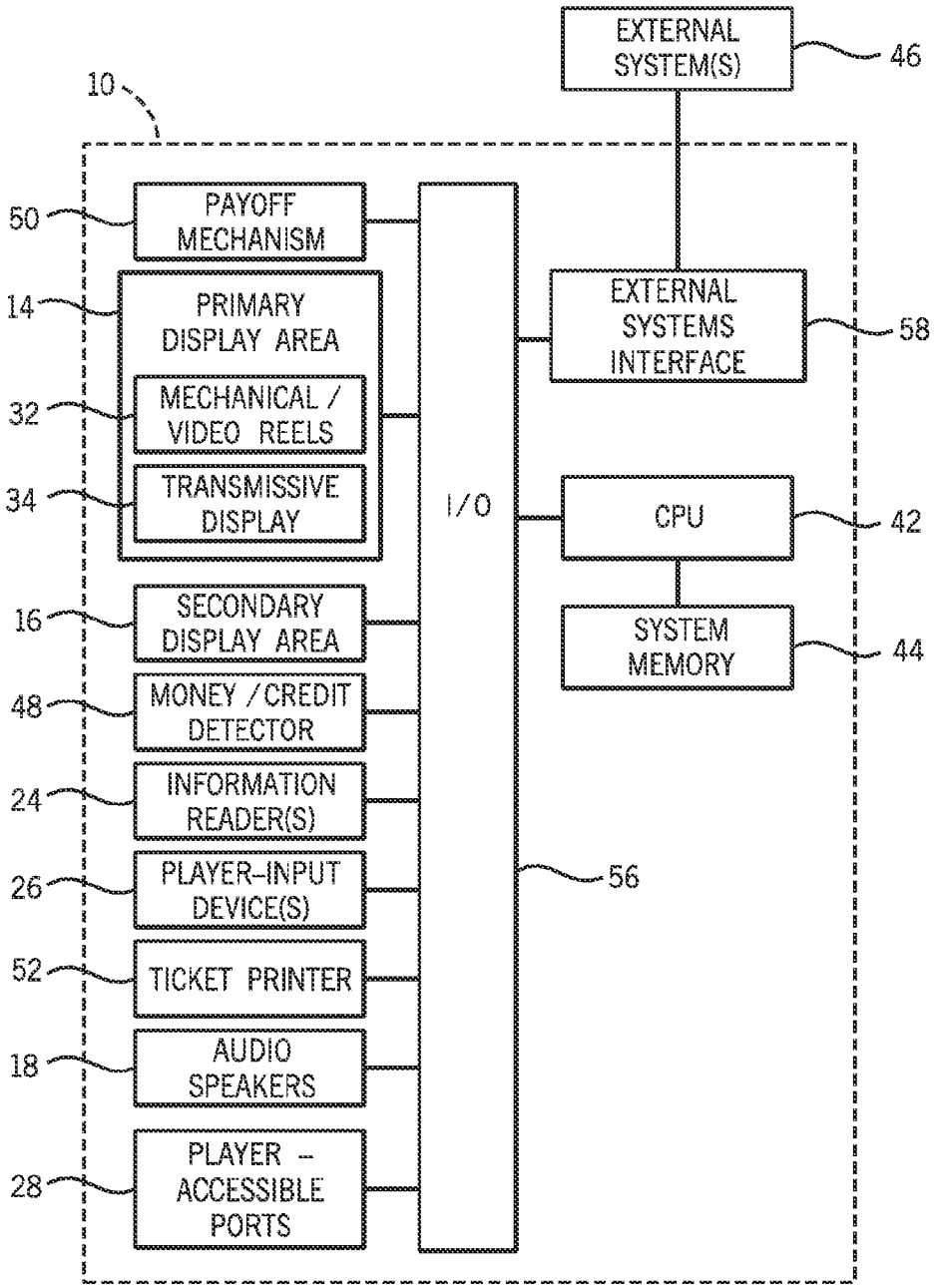
FIG. 2 (Prior Art)
FIG. 2 is a schematic view of a gaming system.

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor, such as an Intel® Pentium processor, Intel® Core 2 Duo processor, AMD Opteron™ processor, or UltraSPARC® processor. To provide gaming functions, the controller 42 executes one or more game programs stored in one or more computer readable storage media in the form of memory 44 or other suitable storage device. The controller 42 uses a random number generator (RNG) to randomly generate a wagering game outcome from a plurality of possible outcomes. Alternatively, the outcome may be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and multiple program memories. The money/credit detector 48 signals the processor that money and/or credits have been input via a value-input device, such as the bill validator 20, coin acceptor 22, or via other sources, such as a cashless gaming account, etc. These components may be located internal or external to the housing 12 of the gaming terminal 10 and connected to the remainder of the components of the gaming terminal 10 via a variety of different wired or wireless connection methods. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 26) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 14, the player-input device 26, and a payoff mechanism 50. The payoff mechanism 50 is operable in response to instructions from the controller 42 to award a payoff to the player in response to certain winning outcomes that might occur in the base game, the bonus game(s), or via an external game or event. The payoff may be provided in the form of money, redeemable points, services, or any combination thereof. Such payoff may be associated with a ticket (from a ticket printer 52), portable data unit (e.g., a card), coins (from a coin outlet 54 shown in FIG. 1), currency bills, accounts, and the like. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface 58, which is connected to the external system 46. The controller 42 communicates with the external system 46 via the external system interface 58 and a communication path (e.g., serial, parallel, IR, RC, 10bT, etc.). The external system 46 may include a gaming network, other gaming terminals, a gaming server, a remote controller, communications hardware, or a variety of other interfaced systems or components.

Controller 42, as used herein, comprises any combination of hardware, software, and/or firmware that may be disposed or resident inside and/or outside of the gaming terminal 10 and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 may communicate with external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

Figure 3:
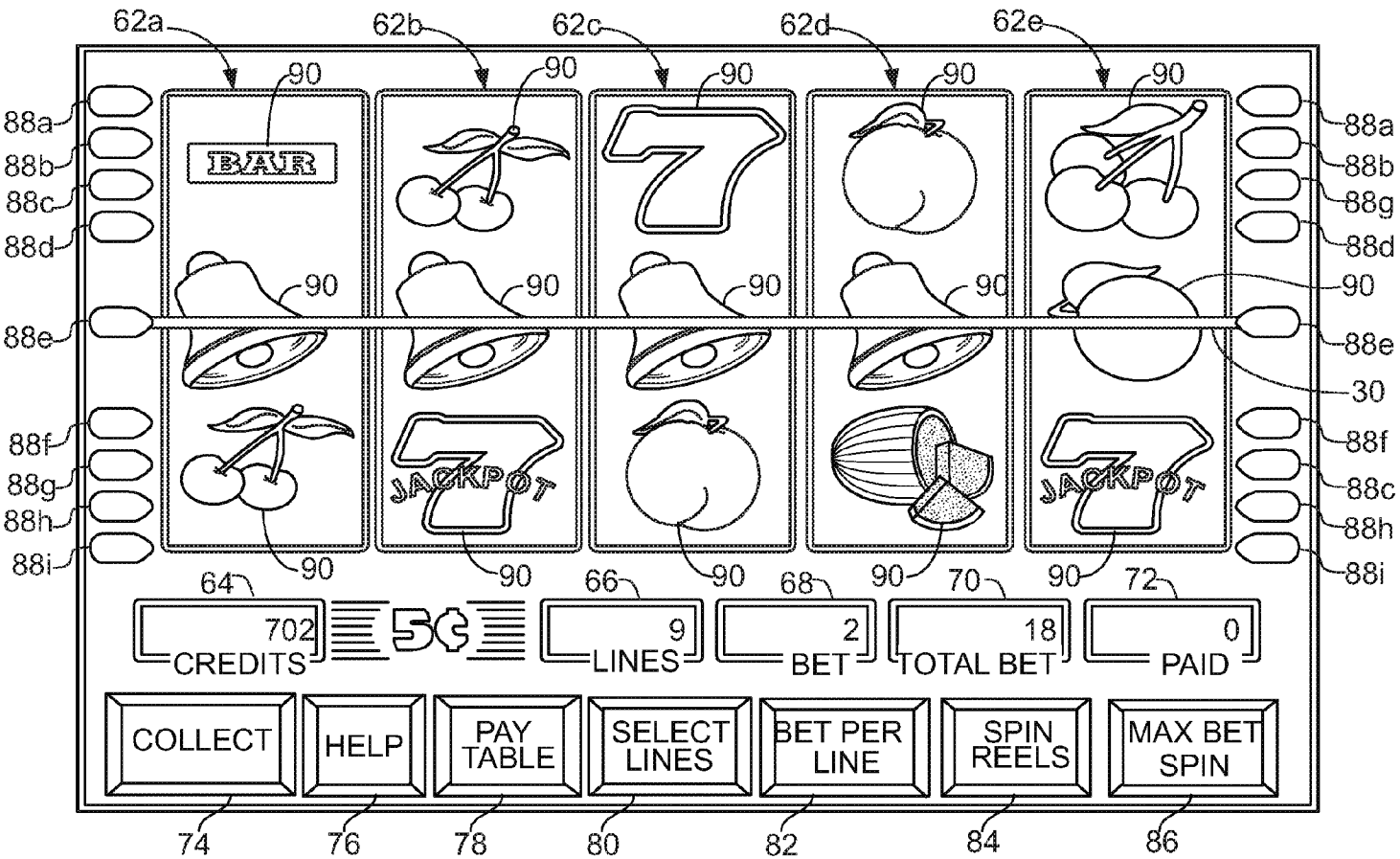
FIG. 3 (Prior Art)
FIG. 3 is an image of a basic-game screen of a wagering game that may be displayed on a gaming terminal.

Referring now to FIG. 3, an image of a basic-game screen 60 adapted to be displayed on the primary display area 14 is illustrated, according to one disclosed example. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

The basic-game screen 60 may be displayed on the primary display area 14 or a portion thereof. In FIG. 3, the basic-game screen 60 portrays a plurality of simulated movable reels 62*a-e*. Alternatively or additionally, the basic-game screen 60 may portray a plurality of mechanical reels. The basic-game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The user-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager that is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present disclosure does not require them and can be used on gaming terminals having more, less, or different player inputs.

Paylines 30 may extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations may be evaluated as line pays or scatter pays. Line pays may be evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present disclosure. Additionally, though an embodiment with five reels is shown, a gaming terminal with any plurality of reels may also be used in accordance with the present disclosure.

Figure 4A:
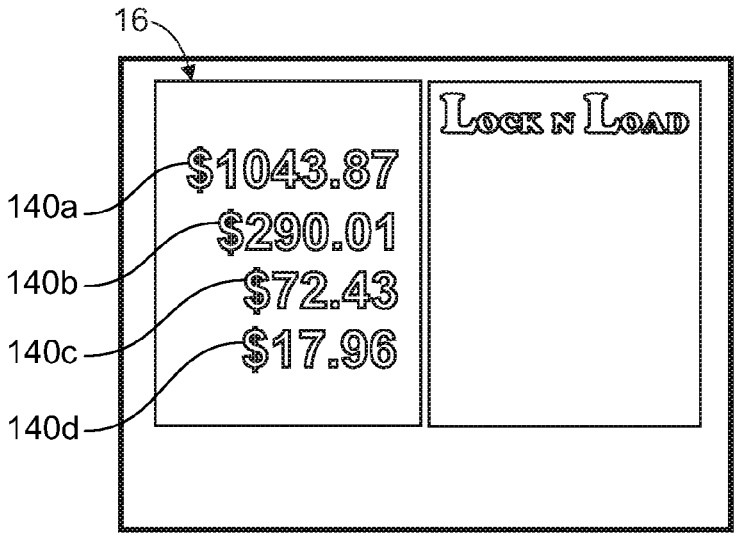
FIG. 4A is an image of an informational screen displayed on a secondary display that includes award values of different progressive jackpots.
Figure 4B:
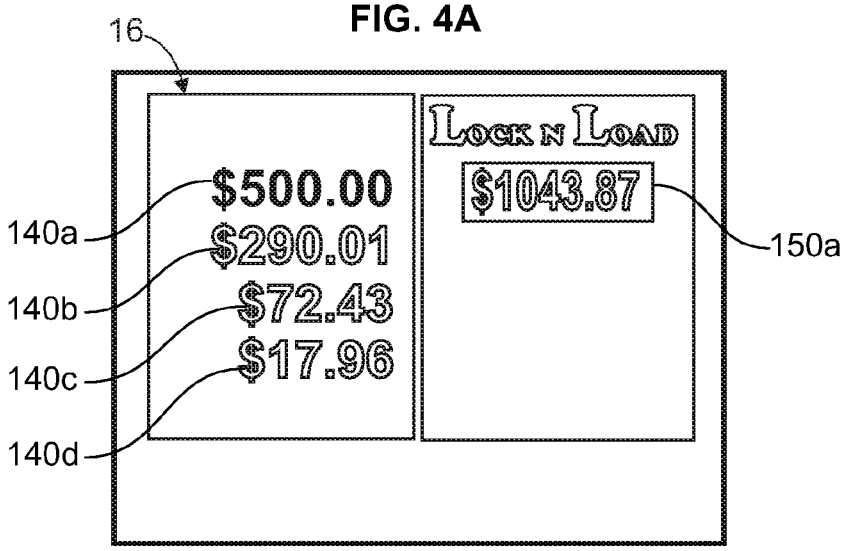
FIG. 4B is another image of the informational screen displayed on the secondary display after the image of FIG. 4A and includes award values of different progressive jackpots for a player that has achieved a certain predetermined criteria for the progressive game.
Figure 4C:
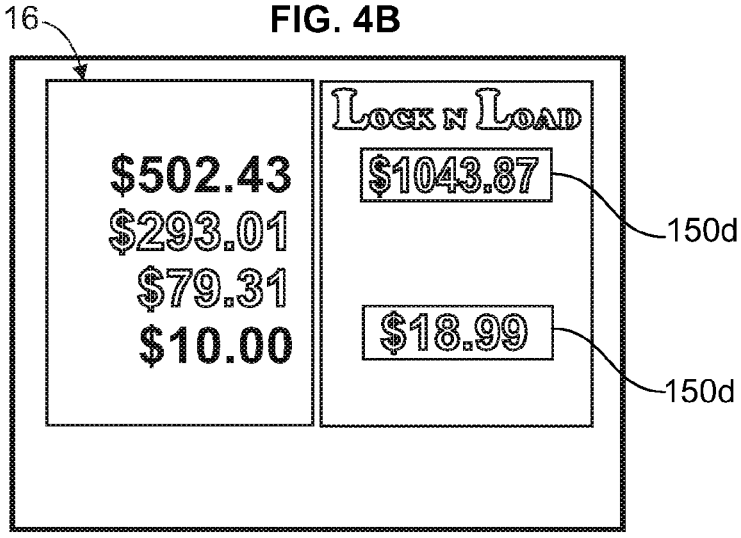
FIG. 4C is yet another image of the informational screen displayed on the secondary display after the images of FIGS. 4A and 4B and includes award values of different progressive jackpots for the player that has achieved the certain predetermined criteria for the progressive game.

Turning now to FIGS. 4A-4C, a display screen on the secondary display 16 illustrates the values of multiple progressive jackpots of a progressive game that can be achieved by the player at the gaming terminal 10. While shown in the secondary display 16, this information related to the progressive game may be alternatively shown on the main display 14 in addition to the basic-game screen, so that the player views the basic game and progressive-game information on one display.

A player begins play of the basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of basic game visual elements, such as those shown in FIG. 1 or FIG. 3. The wagering game includes basic game (e.g. a slots-type game with a plurality of mechanical and/or video reels, or poker) and also allows the player to access and participate in the progressive game, which includes the Lock-n-Load progressive feature described in more detail below.

FIG. 4A illustrates a multi-level progressive game in which there are four progressive jackpots 140*a*, 140*b*, 140*c*, 140*d* displayed on the secondary display 16. The real-time values of the four progressive jackpots 140*a*, 140*b*, 140*c*, 140*d* are conveyed to the player so that the player is continuously aware of award values of the four different progressive jackpots 140*a*, 140*b*, 140*c*, 140*d*. The amounts of the awards of the progressive jackpots 140*a*, 140*b*, 140*c*, 140*d* increase with each wager input placed at the gaming terminal 10 and other terminals 10 linked to the progressive game. Each of the progressive jackpots 140*a*, 140*b*, 140*c*, 140*d* may be, for example, triggered by an outcome in the basic game (e.g., symbol trigger) or by a random event independent of the outcome in the basic game (e.g., mystery trigger). In either alternative, the determination of the triggering event may occur locally (e.g., the CPU 42 in FIG. 2) or remotely in an external system 46, such as through a remote progressive-game controller linked to all of the participating gaming terminals 10.

FIG. 4B illustrates the occurrence of a player at one of the other gaming terminals 10 winning the first progressive jackpot 140*a* with a value of $1043.87, causing the first progressive jackpot to be reset to a value of $500.00. However, the player at the gaming terminal 10 with the second display 16 in FIG. 4B has become eligible for the Lock-n-Load progressive feature in which a maintained award value 150*a* of $1043.87 is maintained or "locked" for that particular player. In other words, although the first progressive jackpot 140*a* has been reset to its base reset value of $500.00 for all other players (including the player who won it), the player at the gaming terminal 10 with the second display 16 in FIG. 4B will still win the maintained award value 150*a* of $1043.87 if he or she triggers the first progressive jackpot. On the other hand, if another player who is not eligible for the Lock-n-Load progressive feature triggers the first progressive jackpot, then he or she will only win $500, or some increment above $500 as the award value increments from the base reset value of $500 due to wager inputs at the gaming terminals 10. It should be noted that several players may be eligible for the Lock-n-Load progressive feature such that several different players at several gaming terminals 10 may have the maintained award value 150*a* of $1043.87 maintained or "locked" for the first progressive jackpot, causing their secondary displays 16 to look like FIG. 4B The players at the various gaming terminals 10, of course, continue playing wagering games during the winning play by the winning player and after the winning player has been awarded the first progressive 140*a*. In doing so, the award values of the progressive jackpots 140*a*, 140*b*, 140*c*, 140*d* continue to increase as wager inputs are made.

At some point, another player will win one of the progressive jackpots 140*a*, 140*b*, 140*c*, 140*d*, which may cause the player of the gaming terminal 10 illustrated in FIGS. 4A-4C to achieve a second aspect of the Lock-n-Load progressive feature. As shown in the first column of FIG. 4C, the award values of the progressive jackpots 140*a*, 140*b*, 140*c*, 140*d* have increased relative to FIG. 4B. FIG. 4C illustrates the occurrence of a player at different one of the gaming terminals 10 winning the fourth progressive jackpot 140*d* with a value of $18.99, causing that fourth progressive jackpot to be reset to a value of $10.00. This winning event for the other player now "locks" this player's fourth progressive jackpot 140*d* in FIG. 4C at a maintained award value 150*d* of $18.99 such that, if that player triggers the fourth progressive jackpot, he or she will win $18.99 as opposed to $10.00 or some increment above that $10.00 amount. Also, the player's first Lock-n-Load progressive feature with the maintained award value 150*a* of $1043.87 for the first progressive jackpot 140*a* is preserved. In other words, the player's continued eligibility for the Lock-n-Load progressive feature has now caused two progressive jackpots 140*a* and 140*d*, which were previously awarded to other players, to be held at higher maintained award values 150*a* and 150*d* for that player. And, if he or she triggers either one (or both) of the two progressive jackpots 140*a* and 140*d* while eligibility has been maintained, he or she will receive the higher maintained award values 150*a* and 150*d*, respectively.

It should be noted that a player who triggers one of the progressive jackpots 140*a*, 140*b*, 140*c*, 140*d* may also be a player who is also eligible for the Lock-n-Load progressive feature. In that situation, the player who is awarded the award value for the progressive jackpot 140 may also have that same progressive jackpot 140 "locked" at a maintained award value 150 that is equivalent to the award value that he or she just won. As such, if the winning player later triggers that same progressive jackpot, he or she will be awarded the maintained value, and not the lower base reset value (or some increment above the base reset value).

Additionally, while this Lock-n-Load progressive feature has been illustrated using four progressive jackpots 140*a*, 140*b*, 140*c*, 140*d*, more or less than four may be used. For example, it is possible to use this Lock-n-Load progressive feature in a progressive game having a single progressive jackpot.

The maintained award values 150 under this Lock-n-Load progressive feature may transition over to the normal incrementing award value for that progressive jackpot 140 at some point in time. For example, if the normal award value increments to point at which it is larger than the maintained award value 150 for a player, then the player is no longer receiving a benefit of the Lock-n-Load progressive feature and the player then becomes eligible for the larger normal award value. Alternatively, the player may lose eligibility over time causing the player to lose the benefit of the larger maintained award value. It may be that the player loses eligibility for only one of the maintained award values 150*a*, while eligibility for the other maintained award values 150*d* continues. Under these scenarios, when the maintained award value 150 for a certain player transitions to the normal award value, the player's maintained award value 150 in the second column of the secondary display 16 in FIGS. 4A-4C may disappear. The disappearance may be accompanied by various graphics and/or a message to help inform the player that he or she is about to lose, or has lost, the benefit of the maintained award value 150.

To permit a player to be eligible for the Lock-n-Load progressive feature, various predetermined criteria can be used. In one alternative, a player who plays at a certain coin input rate may obtain eligibility for the Lock-n-Load progressive feature. For example, if the player is player at a gaming terminal 10 having a $1 maximum wager, and that player is playing at least $6 per minute (one play at the maximum wager every 10 seconds), eligibility may be achieved. In this option, it is also possible to permit a player to build up "eligibility time" with continued game play. The eligibility time may start to decrement after each game ends. Each play may add 2 seconds of time to an eligibility meter, which can be monitored on one of the displays 14 or 16 by the player. The "eligibility time" may be capped at a certain amount of time, such as 20 seconds, which means the player can finish a play of the wagering game and wait for 20 seconds for the next play, and yet still be eligible for the Lock-n-Load progressive feature during that next play.

In another alternative, the player may achieve certain outcomes in the basic wagering game that permit eligibility for the Lock-n-Load progressive feature for a certain amount of time, or for a certain number of game plays (e.g., 10 or 20 spins of the reels in a slot machine) as long as those game plays occur within a certain reasonable time period (e.g. 3 minutes). A timer would be needed to make the player aware that the eligible game plays need to be used in a limited time period.

In another alternative, if player tracking is used, as long as the player is playing the wagering game for a certain number of plays or for a certain number of wagers over a longer period of time (e.g., 3 days), the Lock-n-Load progressive feature may be provided to the player for a certain amount of time, or for a certain number of game plays (e.g., 10 spin or 100 spins of the reels in a slot machine) as long as those game plays occur within a certain reasonable amount of time. Again, a timer would be needed to help inform the player of the limited period of time in which to take advantage of the Lock-n-Load progressive feature.

In a further alternative, if the wagering game is a slots-based game with multiple pay lines 30, if the player is playing at least a certain number of the paylines (e.g. all of the paylines 30), then the wagering game would permit eligibility for the Lock-n-Load progressive feature. That eligibility may last for only a certain number of seconds between each spin to encourage play at a certain minimum rate. In addition, it should be understood that these various predetermined criteria can be mixed and matched, such that various predetermined criteria must be met or one of several predetermined criteria can be met to permit eligibility for the Lock-n-Load progressive feature.

Because players may lose interest in the underlying wagering game after one or more of the progressive jackpots 140 have been awarded, the use of the Lock-n-Load progressive feature allows players the opportunity to achieve some higher award value if he or she triggers the progressive jackpot 140 shortly after it has been awarded to someone else. Consequently, player interest in the game is maintained due to the Lock-n-Load progressive feature. Ultimately, this results in more players staying at the various linked gaming terminals 10 after a progressive jackpot has been awarded, which increases the profitability for the operator of the system (e.g. the casino).

Because the expected value (EV) of the wagering game is regulated by the jurisdiction in which the game operates and should remain consistent among gaming terminals 10, the funding of the Lock-n-Load progressive feature is usually provided by the operator of the gaming machine.

Figure 5:
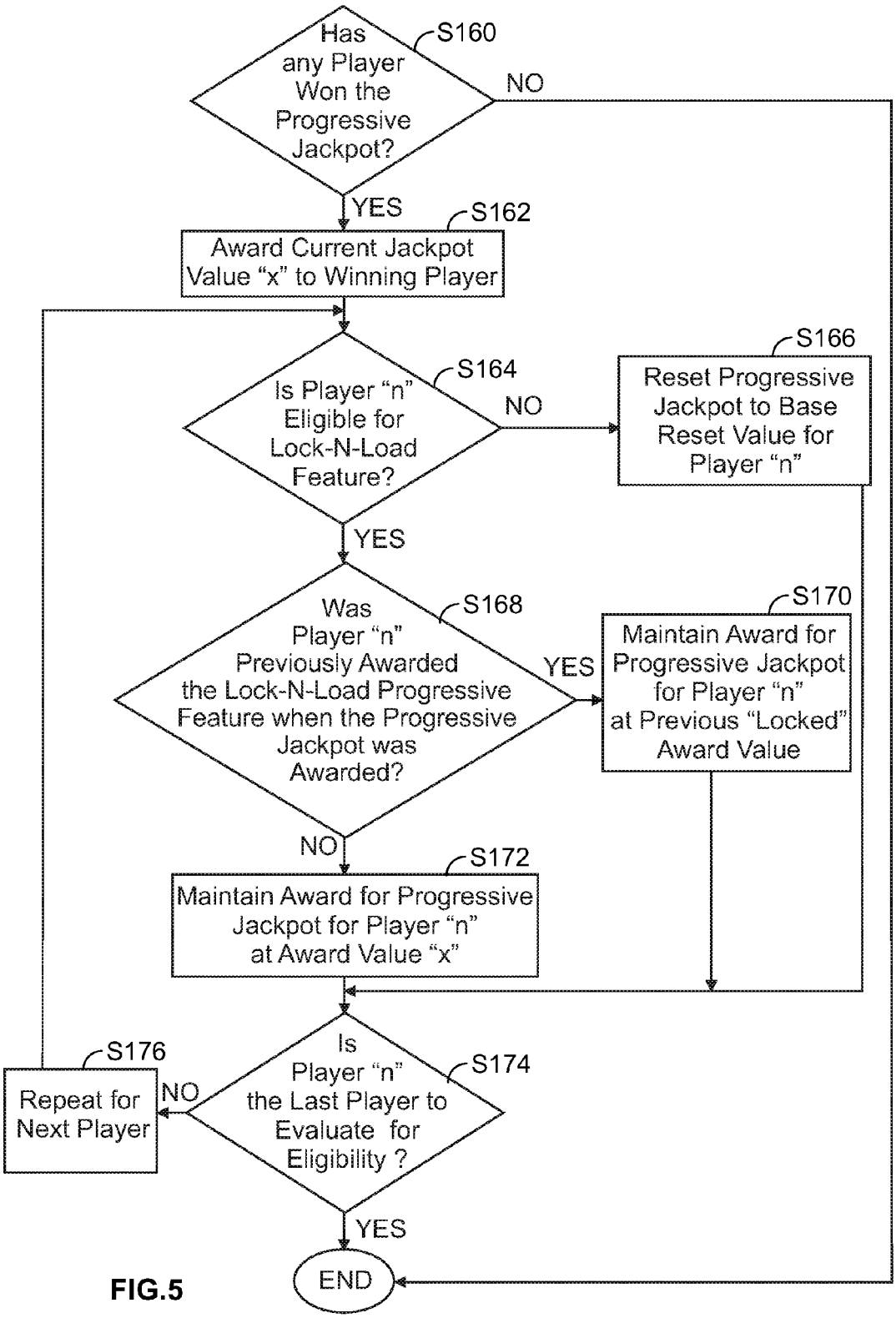
FIG. 5 is a flowchart for an algorithm that corresponds to instructions executed by at least one controller in accordance with the progressive feature of FIGS. 4A-4C.

FIG. 5 illustrates one algorithm that can be used to execute the Lock-n-Load progressive feature of FIGS. 4A-4C. At step S160, there is a check conducted to determine whether any player at the gaming terminals 10 has won the progressive jackpot. If the progressive game involves more than one progressive jackpot, then an algorithm similar to the one in FIG. 5 can be used for each of the other progressive jackpots. If the answer at step S160 is "NO", the algorithm ends, and can be repeated at certain predetermined intervals, or just before or just after each play of the wagering game at one of the gaming terminals 10 has been completed.

If the answer at step S160 is "YES", then the current award value "x" is provided to the winning player at step S162. Then, starting at step S164, the algorithm determines whether each player playing the wagering game at the gaming terminals 10 is eligible for the Lock-n-Load progressive feature. At step S164, if the answer is "NO" for player "n", then the progressive jackpot is reset to the base reset value for player "n" at step S166.

On the other hand, if the answer at step S164 is "YES", then the algorithm proceeds to step S168 and determines whether player "n" was already awarded and using the Lock-n-Load progressive feature. In other words, player "n" may already have a "locked" award value for the progressive jackpot that is higher than the recent award value "x" for the progressive jackpot at step S162. Thus, it is more desirable for player "n" to maintain that previous "locked" award value at the higher level. Accordingly, if the answer at step S168 is "YES", then the algorithm proceeds to step S170, such that the award level for player "n" is maintained at the previously "locked" award value.

However, if the answer at step S168 is "NO", then the algorithm proceeds to step S172 and maintains the award value for the progressive jackpot at the recent award value "x"

at step S162 for player "n". Accordingly, player "n", who is eligible for the Lock-n-Load progressive feature, has maintained an award value for the progressive jackpot that is higher than the reset award value provided to players at step S166 who were not eligible for the Lock-n-Load progressive feature at the time that the progressive jackpot was triggered by the winning player.

According to the algorithm of FIG. 5, each player at the gaming terminals 10 has three options for his or her award value for the progressive jackpot after it has been won by the winning player, as indicated in steps S166, S170, and S172. The algorithm then proceeds to determine whether player "n" was the last player requiring evaluation for eligibility at step S174. If player "n" is the last player, indicated by an answer of "YES" asked to S174, then algorithm ends. Alternatively, if player "n" is not the last player, the algorithm repeats starting at S164 for the next player (S176).

Again, FIG. 5 represents one algorithm that corresponds to some of the instructions executed by the CPU 42 and/or processors in the external systems 46 in FIG. 2 to perform the functions associated with the Lock-n-Load progressive feature. The system memory 44 may store these instructions for one or more aspects of the methods and systems as described herein. Or, a memory in the external system 46 (e.g., progressive game controller) can be used. The skilled artisan will understand that there are many variations to this algorithm that could achieve the same result. Further, while the algorithm can be performed by one processor, some steps in the algorithm can be performed by separate processors. For example, the portion of the algorithm from steps S164-S172 can be performed by the CPU 42 in each individual gaming terminal 10 at which the wagering game is being played after the progressive award has been won by the winning player.

Figure 6:
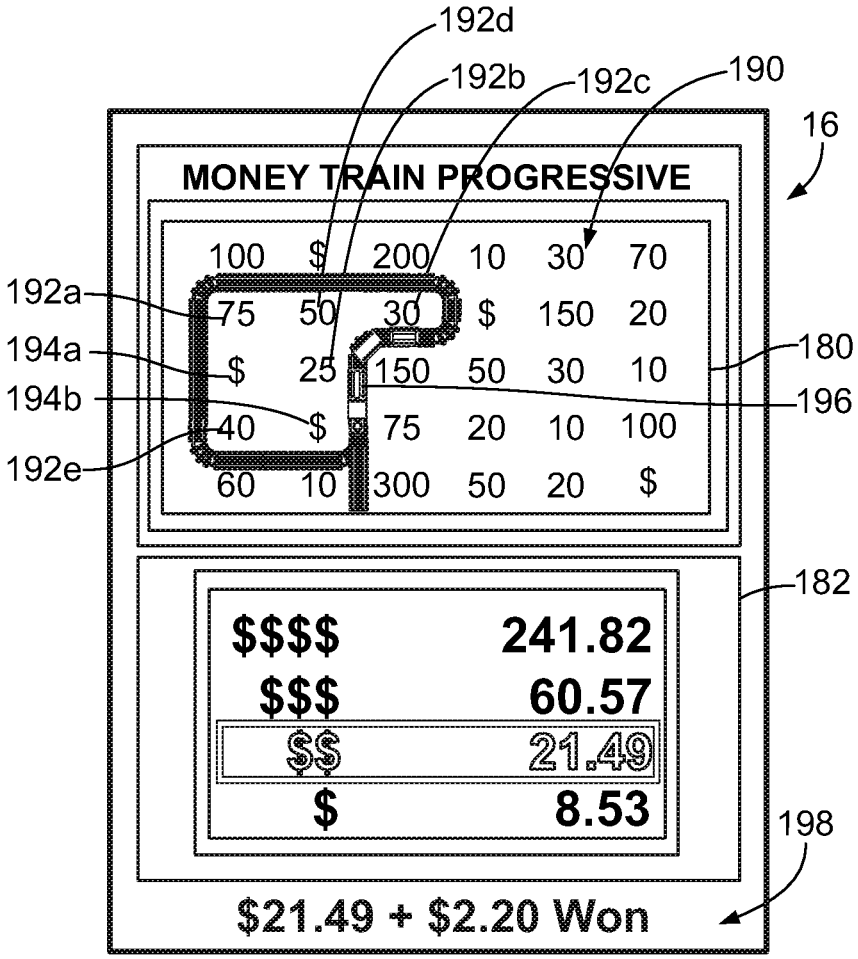
FIG. 6 is an image of a display that shows a unique manner in which to display to a player which one of the progressive jackpots has been achieved.

FIG. 6 illustrates a play mechanic for a progressive game that is used to graphically instruct to the player which one of multiple progressive jackpots has been achieved by the player. After the player has triggered the win of one of the progressive jackpots but before being informed which progressive jackpot has been won, the secondary display 16 transitions to a screen in which there is a progressive game grid 180 and a progressive award table 182. The progressive game grid 180 includes an array of indicia 190 that includes award value indicia 192 and progressive level indicia 194. An animated train 196 then begins to move through the progressive game grid 180. As the animated train 196 moves through the progressive game grid 180, it leaves behind an animated track. In other words, initially, there is no track on the progressive game grid 180. As the animated train 196 moves, the track it leaves behind will circumscribe a group of indicia within the array of indicia 190. The player is hoping that the animated train 196 creates as large of a path as possible so as to circumscribe the largest group of indicia within the array of indicia 190, because the more that is circumscribed, the higher the award to the player. In this instance of FIG. 6, the train 196 has moved upwardly from the bottom of the grid 180, taken a left turn after the lowermost row, and completed an enclosed path in a clockwise fashion that circumscribed seven members of the array of indicia 190.

The circumscribed seven members of the array of award indicia 190 dictate the award for the player. Because five of them are the award value indicia 192*a*-192*e* (measured in cents in the illustrated embodiment), the player is awarded the total of $2.20 ($0.75+$0.50+$0.30+$0.25+$0.40). Furthermore, because two of them are the progressive level indicia 194*a*-194*b* (i.e., dollar signs), the player is awarded the progressive jackpot associated with the two dollar signs, which in this case has a value of $21.49. As such, the player has been awarded a progressive jackpot and an additional bonus award that are summed together, as shown in a final award indicator 198 at the bottom of the secondary display 16. The play mechanic for the progressive game in FIG. 6 may be one that is used when a player triggers (i.e. wins) one of the progressive jackpots, as discussed relative to the Lock-n-Load progressive feature of FIGS. 4-5.

As mentioned above, each jurisdiction has requirements for the wagering games that are operated in that jurisdiction. One of those requirements relates to the expected value (EV) for each play of the wagering game. In basic terms, the EV may be thought of as the amount, on average, that will be returned to the player if the player were to play the wagering game over an extended period of time. When the wagering game includes a basic game that provides access to a progressive game, then the total EV for the wagering game is summation of the EV for the basic game and the EV for the progressive game. If the progressive game has multiple jackpot levels, such as those described above with reference to FIGS. 4-6, then the EV for the progressive game is the summation of the EV of each progressive jackpot level within the progressive game. Furthermore, because each progressive jackpot will increase and decrease as a function of time, the EV associated with each progressive jackpot will also increase and decrease.

To ensure that each play of the wagering game meets the jurisdictional requirements for minimum EV (e.g., 83%), in many current games, the basic game has an EV that is set at the minimum EV for the jurisdiction. The progressive game contributes a much smaller portion of the EV (e.g., 4% on average) causing the overall fluctuation of the total wagering game EV to be less because the progressive game jackpot's fluctuation is less.

However, as mentioned previously, many players are attracted to wagering games having progressive jackpots that increment at a rapid rate and transition through a large range of values. However, the EV's of these progressive jackpots that increment at a rapid rate have a much larger variance. And, they require more funding from the wager inputs used for playing the basic game. Accordingly, to develop such a wagering game with progressive jackpots that increment at a rapid rate, one option is to reduce the EV associated with basic game and increase the EV associated with the progressive game. But in this option, there is a larger fluctuation in the overall EV for each play of the wagering game such that, in some instances, the wagering game may fall below the jurisdictional requirement for the minimum EV, which is a problem.

FIG. 7 illustrates an example of a typical wagering game in which the EV for the basic game is dropped to 75%, which is below the jurisdictional requirement that is assumed to be 83% in all of the following examples. In these examples, it is also assumed that the wager input for each game is on a $1 dollar basis for purposes of simplicity.

In the example of FIG. 7, there are five progressive jackpot levels in the progressive game and each participating player on any gaming terminal 10 would be eligible to win each the five progressive jackpot levels. FIG. 7 provides four different progressive-game parameters for each of the five progressive jackpot levels. These four progressive-game parameters are (i) the reset value, (ii) the probability in percentage, (iii) the increment in percentage, and (iv) the strike price.

The "reset" value is the normal value to which the progressive level will be reset after one of the players has been awarded the progressive jackpot. The "probability" percentage is the measurement of the likelihood that the progressive jackpot will be awarded on each play. For example, the highest level jackpot, Level 1, has a probability of 0.0005%, which means that, on average, it will be awarded once every 200,000 plays of the wagering game (i.e., 1/0.000005). The "increment" is the percent of each wager input that is allocated to a particular jackpot level. For example, the highest level jackpot, Level 1, has an increment of 1%, which means for every $1 dollar wager input to play the wagering game, there is $0.01 contributed to the award for jackpot Level 1. Finally, the "strike price" is the mean average jackpot amount at which, according to mathematical probabilities, the jackpot award should be awarded to player. When viewing Level 1, considering (a) that the probability of achieving Level 1 means that, on average, Level 1 will be awarded once every 200,000 plays of the wagering game and (b) that each play of the wagering contributes 1% of the wager input for incrementing that jackpot award ($0.01/spin), then after 200,000 plays, that average awarded jackpot amount (i.e., the strike price) for Level 1 is $4,000, which is the reset value of $2,000 plus the incremented value of $2000 (200,000 spins times $0.01/spin). The same analysis can be applied to Levels 2, 3, 4, 5 in the progressive game according to FIG. 7.

FIG. 7 is also used to determine the EV provided by each level of the progressive game. The minimum EV for the progressive game will always occur when all of Levels 1-5 are at the reset value such as, for example, when the progressive game is first "booted up". The minimum EV for each level is simply the reset value multiplied by the probability. In the progressive game according to FIG. 7, each level contributes 1% to the EV such that the overall progressive game minimum (or reset) EV is 5% (Level 1-$2000*0.000005=1%; Level 2-$500*0.00002=1%; Level 3-$100*0.0001=1%; Level 4-$20*0.0005=1%; Level 5-$10*0.001=1%). Thus, if all of the levels are at the reset value, then the overall wagering game EV is 80%, which is the minimum EV for the game (75% basic game+5% progressive game). Accordingly, if a player were to play the wagering game at this condition over an extended period of time, then, according to mathematical probabilities, he or she would expect to receive back 75% of the total wager inputs due to winning outcomes from the basic game and another 5% of the total wager inputs due to winning outcomes from the progressive game.

Considering the progressive game of FIG. 7, under average playing conditions (i.e., the condition in which each progressive level is at the strike price), the average EV for each of the progressive jackpots is its strike price multiplied by its probability. In FIG. 7, the progressive game average EV is 13% (Level 1-$4000*0.000005=2%; Level 2-$1000*0.00002=2%; Level 3-$200*0.0001=2%; Level 4-$60*0.0005=3%; Level 5-$40*0.001=4%). Looking at it another way, after the reset of the progressive levels, 8% of each wager input from the players causes the value of the progressive jackpots to increase (distributed among Levels 1-5), such that the 8% is added to the 5% EV at reset value, causing the progressive game average EV to be 13% at the strike price. Thus, the increment percentage for each level on FIG. 7 is the additional EV associated with the incrementing from wager inputs at the point when the jackpot is at its strike price.

Consequently, if all of the levels are at the strike price value, then the average wagering game EV is 88% (75% basic game+13% progressive game). So, if a player were to play the wagering game at this average condition over an extended, then, according to mathematical probabilities, he or she would expect to receive back 75% of the total wager inputs due to winning outcomes from the basic game and another 13% of the total wager inputs due to winning outcomes from the progressive game. This is an average scenario for the player who plays this wagering game.

It is noteworthy that the actual progressive game awards for several (or all) of the progressive jackpot levels will exceed the strike price at certain times. In fact, because of the randomness associated with triggering the award of each jackpot level, the actual progressive game EV can exceed 25%. In other words, if there is a period of time in which no progressive awards (or only a few) are made, the values of each progressive level may increase to a point at which the EV for the overall wagering game exceeds 100%. When these types of conditions occur, the progressive levels may increase at even a faster rate because many players now become more attracted to the wagering game because they realize that, upon viewing a display in which the award levels are display, there has not been a progressive game award in a while and the award levels are higher than normal.

If the wagering game of FIG. 7 is located in a jurisdiction in which the minimum permitted EV is 83%, then the wagering game could be operating outside the jurisdictional requirements. While the wager game will normally exceed the 83% minimum EV by operating on average with about an EV of 88%, there are conditions that can occur that will cause the EV to drop below 83%. For example, if several (or all) of the levels are awarded within a short period of time, then the EV of the progressive game will drop, causing the overall EV of the wagering game to be less than 83% (and possibly down to near the minimum wager game EV of 80%).

To overcome this problem of the wagering game having an EV below the jurisdictional requirement (e.g., 83%) while still providing a progressive game with jackpot levels that increase at rapid rates, the present disclosure provides for a padded reset value for the progressive game. The padded reset value can be applied to one or more of the progressive levels under certain conditions to force the overall wagering game EV to exceed the jurisdictional requirement under any possible condition. FIG. 8 will describe one aspect of the present disclosure in which the padded reset value is predetermined for one or more of the progressive jackpots levels. FIG. 9 will describe another aspect of the present disclosure in which the padded reset value is determined based on the current conditions of each of the progressive jackpot levels.

Referring initially to FIG. 8A, it will be noted that the upper portion of the table in FIG. 8A is identical to the example in FIG. 7, except that FIG. 8A also includes columns on the right side of the table that are associated with the padded reset value for each of the progressive levels. The padded reset value for each progressive level is the reset amount that is used in some circumstances after a progressive level has been awarded to a player so as to cause the overall EV of the wagering game to be at least at the minimum jurisdictional requirement (e.g., ≧83%). The padded reset value for each of the progressive levels is higher than the normal reset value. The difference between the padded reset value and the normal reset value, multiplied by the probability of achieving each level results in the "Additional EV" that is present in final column [i.e., ($3000-$2000)*0.000005=0.5%; ($750-$500)*0.00002=0.5%; ($150-$100)*0.0001=0.5%; ($30-$20)*0.0005=0.5%; ($20-$10)*0.001=1%]. Accordingly, choosing to use the padded reset value instead of the normal reset value causes the overall wagering game EV to increase by a known percentage (i.e., increase by 0.5% or 1.0% in this example).

As shown, the summation of the additional EV for Levels 1-5 that is brought about by the padded reset values is 3%. Thus, in a situation in which all the padded reset values are utilized at one time, the total wagering game EV will be at the jurisdictional minimum of 83% (75% EV of the basic game+5% EV for the reset values of the progressive game+3% additional EV for the padded reset values). When the progressive game "boots up", the values chosen for the reset values will be the padded reset values to ensure that the 83% jurisdictional requirement is met.

FIG. 8B illustrates one possible real-world operating scenario (State 1) for the progressive game having the parameters set forth in FIG. 8A. Each of Levels 1-5 has a value that is above its normal reset value, but below its strike price. And, this results in the total wagering game EV to be 85.52% (the 75% EV for the basic game, plus the summation of the EV for each progressive jackpot level), which is less than the average wagering game EV of 88% (FIG. 8B) because all of the progressive jackpot levels are below their strike prices.

FIG. 8C illustrates jackpot Level 5 of the progressive game being awarded to a player (i.e., a $36.57 progressive jackpot award), which causes Level 5 to be reset to the normal reset value of $10.00. However, when this occurs, the EV for Level 5 drops from 3.66% to 1.00%, causing the total wagering game EV to fall to 82.86%, which is below the jurisdictional requirement of 83% (State 2*a*). In this scenario, the progressive game uses the predetermined padded reset value of $20.00 for Level 5, instead of the normal reset value of $10.00. By using the padded reset value for Level 5, the total wagering game EV increases above the 83% threshold to 83.86% (States 2*b*). At this point, the additional wager inputs associated with additional plays of the wagering games from the various players would start the incrementing process again.

FIG. 8D illustrates an alternative scenario in which another jackpot level, Level 4, is awarded to a player immediately after the awarding of jackpot Level 5 in FIG. 8C (State 3*a*). When this occurs, even the use of the padded reset value for Level 4 ($30.00) results in the total wagering game EV to be only 82.75%, which is below the 83% jurisdictional requirement (State 3*b*). To overcome this problem, another one of the non-awarded progressive levels is increased from its current actual value to its padded reset value so as to increase the overall EV for the progressive game and, thus, increase the total wagering game EV. In the case of FIG. 8D, jackpot Level 1 also increases from its actual value of $2,277.00 to its padded reset value of $3000.00, causing the total wagering game EV to increase to 83.11%, which is above the 83% jurisdictional requirement (State 3*c*).

In summary, according to FIG. 8, after a progressive level is awarded, the normal reset value is chosen. If that normal reset value does not result in a total wagering game EV to be at least 83%, than the padded reset value for that level is chosen. If the padded reset value does not result in the total wagering game EV to be at least 83%, then the award value(s) for one or more of the non-awarded levels is increased from its current value to the padded reset value to cause the total wagering game EV to be at least 83%.

It should be noted that, in this latter situation in which the padded reset value for the awarded progressive level fails to cause the total wagering game EV to exceed 83%, the progressive game can use an algorithm to select from among the non-awarded levels to determine which non-awarded level causes the total wagering game EV to exceed 83% by the least amount. In other words, because operating closer to the jurisdictional requirement of 83% may be more beneficial for the operator of the progressive game, choosing a padded reset value that results in the total wagering game EV being 83.1% may be better than choosing a padded reset value that results in the total wagering game EV being 83.5%. In fact, in the embodiment of FIG. 8 in which the padded reset values for the levels are predetermined, if using the normal reset value for an awarded progressive level causes the total wagering game EV to fall below the jurisdictional requirement of 83%, it may be more desirable to reset the awarded progressive level to the normal reset value and, at the same time, increase the actual award value of a non-awarded progressive level to its padded reset value such that the total wagering game EV is closer to, but still exceeds, the jurisdictional requirement of 83%.

FIGS. 9A-9C illustrate an alternative aspect of the present disclosure in which the padded reset value is calculated based on the current conditions of each of the progressive jackpot levels. FIG. 9A is slightly different from FIG. 8A in that FIG. 9 does not include a column for the padded reset values for each of the five progressive levels. As will be described below, a controller calculates the appropriate padded reset value "on the fly", which means that the EV associated the padded reset value is a to-be-determined percentage (TBD %) that causes the total wagering game EV to be substantially close to, but slightly exceed the minimum limit of 83%. Because the award value for each progressive jackpot level is limited to the one-hundredths place (i.e., $0.01), causing the overall wagering game EV to be exactly 83% is difficult or impossible in most situations.

Like FIG. 8B, FIG. 9B illustrates one possible real-world operating scenario (State 1) for the progressive game having the parameters set forth in FIG. 9A. Each of Levels 1-5 has a value that is above its normal reset value, but below its strike price. The total wagering game EV is 85.52% (the 75% EV for the basic game, plus the summation of the EV for each progressive jackpot level).

FIG. 9C illustrates jackpot Level 5 of the progressive game being awarded to a player (i.e., a $36.57 progressive jackpot award). However, if Level 5 is reset to the normal reset value of $10.00, the EV for Level 5 drops from 3.66% to 1.00%, causing the total wagering game EV to fall below the jurisdictional requirement of 83% (State 2*a*). In this scenario, a calculation is undertaken to determine a value for the padded reset value that will cause the total wagering game EV to be substantially at 83% (i.e., the minimum jurisdictional limit). As mentioned above, the EV of the wagering game ($EV_{WG}$) is the summation of the EV of the basic game ($EV_{Base}$) and the EV of the progressive game ($EV_{Progressive}$).

$$EV_{WG}=EV_{Base}+EV_{Progressive}$$

$$EV_{WG}=EV_{Base}+V_{L1}*P_{L1}+V_{L2}*P_{L2}+V_{L3}*P_{L3}+V_{L4}*P_{L4}+V_{L5}*P_{L}$$

where $V_{Ln}$=current value of jackpot level "n" and $P_{Ln}$=probability of jackpot level "n"

Thus, the calculation to determine a value for the padded reset value that causes the total wagering game EV to be substantially at 83% when the EV for the basic game is fixed at 75% is as follows:

$$V_{L5}=(EV_{WG}-EV_{Base}-V_{L1}*P_{L1}-V_{L2}*P_{L2}-V_{L3}*P_{L3}-V_{L4}*P_{L4})/P_{L5}$$

$$V_{L5}=(0.83-0.75-V_{L1}*P_{L1}-V_{L2}*P_{L2}-V_{L3}*P_{L3}-V_{L4}*P_{L4})/P_{L5}$$

When these values and probabilities for each progressive jackpot level are plugged into this formula, the value for Level 5 ($V_{L5}$) is determined to be $11.53 (State 2*b*). Once this value for Level 5 is established, the progressive game continues from this point. Each additional wager input from the various players associated with additional plays of the wagering games will start the incrementing process again.

Also, when the progressive game according to FIG. 9 "boots up", the values chosen for the reset values will be the padded reset values calculated in a way to ensure that the 83% jurisdictional requirement is met. Alternatively, the progressive game may have a "boot up" mode at which known reset values are used that will achieve the 83% jurisdictional requirement.

Under the embodiments of FIGS. 8-9, the use of the padded reset value permits the progressive game to have a total larger EV and an associated rapid rate of incrementing, while the basic game has a smaller EV that is below the jurisdictional limit. The rapid rate of incrementing the progressive jackpot levels causes more players to be attracted to various types of wagering games having access to the progressive game. Further, when the padded reset values are used, the higher displayed progressive jackpots serve as a further incentive for players to play the wagering game. Preferably, the use of the padded reset value instead of the normal reset value can be displayed (for example, through animation) to all the players in a highlighted fashion to show them that they are receiving some type of additional benefit by having a higher reset value for the progressive level.

Figure 10:
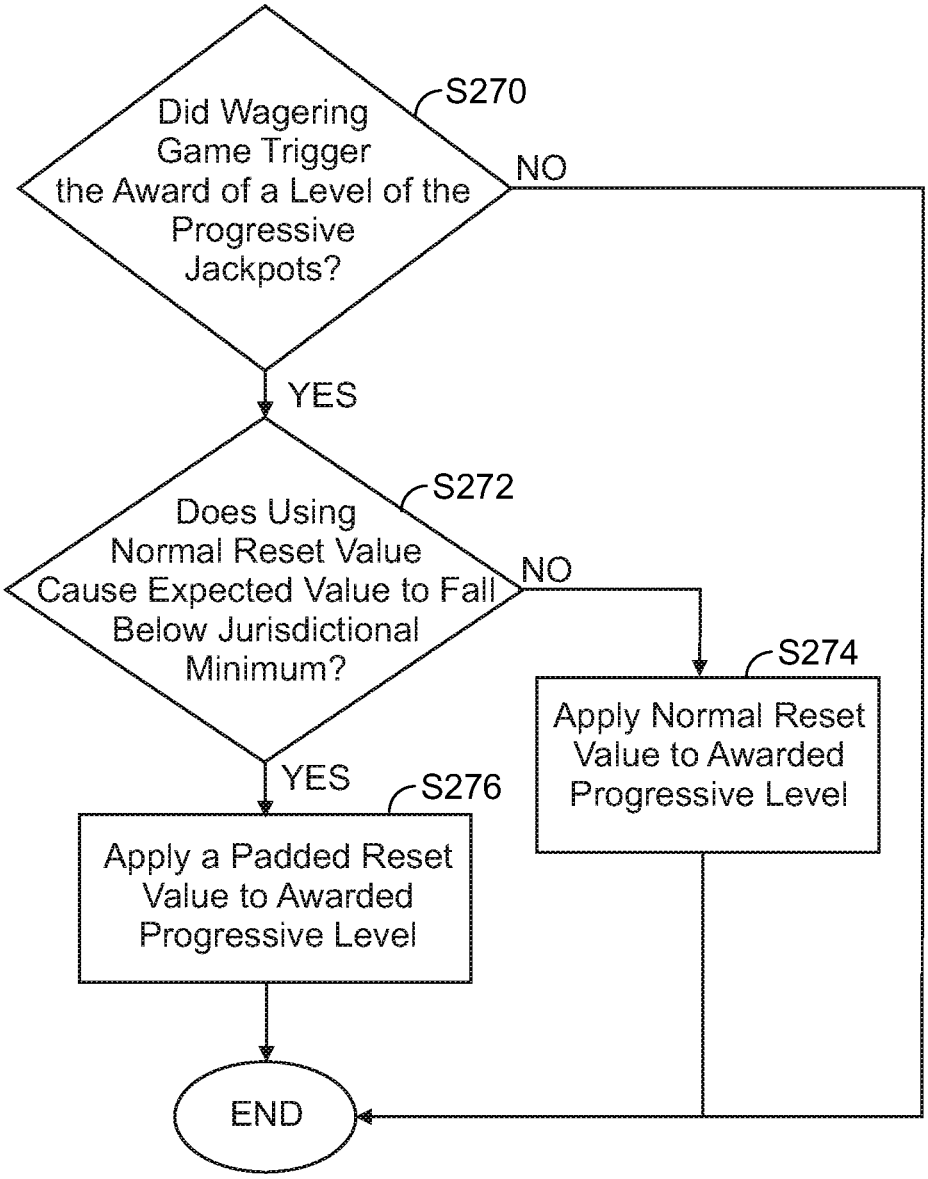
FIG. 10 is a flowchart for an algorithm that corresponds to instructions executed by at least one controller in accordance with the padded reset feature for a progressive game.

FIG. 10 describes one algorithm that can be used to implement the padded reset function for the progressive games, as described above with regard to FIGS. 8-9. For each play of the wagering game, it is first determined whether there has been an award of one of the progressive jackpot levels at step S270. If the answer is "NO" at step S270, the algorithm ends. Alternatively, if the answer is "YES" at step S270, the algorithm proceeds to step S272 at which it is determined whether the use of the normal reset value for the awarded progressive jackpot level will cause the EV for the wagering game to fall below the jurisdictional minimum (e.g. below 83%). If the answer is "NO" at step S272, the algorithm proceeds to step S274 and the normal reset value is applied to the awarded progressive jackpot level. On the other hand, if the answer is "YES" at step S272, the algorithm proceeds to step S276 and a padded reset value is applied to the awarded progressive jackpot level.

Within step S276, the algorithm may employ the functionality of FIG. 8 in which one or more predetermined padded reset values are applied to the progressive jackpot levels to ensure that the EV for the wagering game is above 83%. Or, within step S276, the algorithm may employ the calculations of FIG. 9 to determine a certain amount for one (or more) padded reset value, which is then applied to the progressive jackpot level to ensure that the EV for the wagering game is substantially at 83%. It is noted that FIG. 10 represents just one of many possible algorithms that correspond to some of the instructions executed by the controller 42 and/or external systems 46 in FIG. 2 to perform the padded reset function.

One skilled in the art will recognize that any EV can be chosen as the target point for the padded reset value feature. In other words, instead of focusing on having the EV for the game be at least at a minimum jurisdictional requirement (e.g. 83%), a higher EV may be chosen (i.e. the limit does not need to be the jurisdictional limit). For example, if a casino wanted to attract more players at certain times of the day, then the casino may be able to do so by raising the EV of the wagering games participating in a casino-wide progressive through the padded reset function mentioned above. In other words, the padded reset function may be used to increase the EV only at certain times.

Additionally, it should be understood that the wagering game may include the basic game and a bonus game (i.e., a secondary game) that is triggered from the basic game, in addition to the progressive game. A bonus game may have a fixed EV as well, just like the basic game. Additionally, the basic game, which triggers the bonus game, can be considered to include the bonus game in the present application such that the EV for the basic game implicitly includes the EV for the bonus game(s) triggered in the basic game.

Furthermore, an alternative method by which to adjust the total wagering game EV involves altering the EV of the basic game without the use of the padded reset feature. For example, if a progressive jackpot level is awarded and it is reset to the normal reset value, causing the total wagering game EV to be below 83% (e.g., FIG. 9C, State 2*a*), then the top-level award for the basic game (e.g. five "7" symbols along a pay line) on each participating gamine terminal 10 can be increased to a different level to cause the EV for the basic game to increase. A calculation, similar to the one described above in FIG. 9, can be conducted for the basic game to choose the new value for the upper level award in the basic game with the progressive jackpot awards and the probabilities being known values in the equation. This increased award value for the upper level award may be temporary, such that when the EV of the progressive game achieves a level that causes the total wagering game EV to be above the jurisdictional limit, the increased award value for the upper level award adjusts downwardly to its normal value. Or, this basic game award can be considered and advertised as a constantly fluctuating award in the basic game that is always counteracting the changing EV of the progressive game due to the incrementing from wagering inputs and the awarding of progressive jackpots.

Of course, in this alternative method in which the EV of the basic game is adjusted, there are several other ways in which to do so. For example, a basic-game award other than the top-level award can be adjusted. Or, a new winning symbol combination can be added to the pay table. In a further alternative, a new scatter symbol award can be applied as well. And, combinations of these EV-altering parameters in the basic game can be used together.

Furthermore, it should be noted that different types of wagering games can still be competing in the same progressive game. In other words, players may be competing in the same progressive game, but playing different types of underlying basic games (e.g., slots games and video poker games). These EV-altering methods and system can be applied to progressive games in which various basic games are being played.

Each of these embodiments and obvious variations thereof is contemplated as falling within the spirit and scope of the claimed invention, which is set forth in the following claims.

What is claimed is:

1. A control module for a gaming system including a plurality of gaming terminals configured to play wagering games, each of the wagering games providing access to a progressive game having multiple progressive jackpots such that players at each of the gaming terminals can win the same multiple progressive jackpots, each of the multiple progressive jackpots having a base reset value and a current value increasing from the base reset value in response to wager inputs at the plurality of gaming terminals, each of the gaming terminals including a display for displaying the current values of the same multiple progressive jackpots, the gaming-system control module comprising:

at least one controller operative to:

determine that a first player at a first one of the plurality of gaming terminals has achieved a predetermined criteria while playing the wagering game;

provide an award associated with one of the multiple progressive jackpots to a second player at a second one of the plurality of gaming terminals who triggered the awarded one of the multiple progressive jackpots;

after providing the award, maintain the value of the awarded one of the multiple progressive jackpots for the first player who has achieved the predetermined criteria and reset the awarded one of the multiple progressive jackpots to the base reset value for other ones of the plurality of gaming terminals.

2. The gaming-system control module of claim 1, wherein the predetermined criteria relates to the rate of wager inputs from a player, the first player having a rate of wagering inputs above a certain threshold.

3. The gaming-system control module of claim 1, wherein the wagering game is a slot game having a plurality of reels within a display region, the slot game having a plurality of pay lines, the predetermined criteria relates to a minimum number of pay lines being played, the first player playing at least the minimum number of pay lines.

4. The gaming-system control module of claim 1, wherein, after being reset for the other ones of the gaming terminals, a value of the awarded one of the multiple progressive jackpots for the other ones of the gaming terminals is incremented from the base reset value to a new award value in response to additional wager inputs at the plurality of gaming terminals, the maintained value of the awarded one of the multiple progressive jackpots for the first player at the first gaming terminal transitioning to the new award value when the new award value exceeds the maintained value for the first player.

5. The gaming-system control module of claim 1, wherein the at least one controller is further operative to:

provide a second award associated with a second one of the multiple progressive jackpots to a third player at a third one of the plurality of gaming terminals who triggered the second one of the multiple progressive jackpots;

after providing the second award, maintain the value of the second awarded one of the multiple progressive jackpots for the first player at the first one of the gaming terminals who has achieved the predetermined criteria.

6. The gaming-system control module of claim 5, wherein the at least one controller is further operative to, after providing the second award, reset the second awarded one of the multiple progressive jackpots to the base reset value for other ones of the plurality of gaming terminals.

7. The gaming-system control module of claim 1, wherein the at least one controller is further operative to:

determine that a third player at a third one of the plurality of gaming terminal has achieved the predetermined criteria while playing the wagering game;

after providing the award to the second player, maintain the value of the awarded one of the multiple progressive jackpots for the third player at the third one of the plurality of gaming terminals who has achieved the predetermined criteria.

8. The gaming-system control module of claim 1, wherein the gaming system includes a progressive-game controller for controlling aspects of the progressive game and each of the gaming terminals has a gaming-terminal controller, the at least one controller including the gaming-terminal controllers and the progressive-game controller.

9. The gaming-system control module of claim 1, wherein, after being reset for the other ones of the gaming terminals, a value of the awarded one of the multiple progressive jackpots for the other ones of the plurality of gaming terminals is incremented from the base reset value to a new award value in response to additional wager inputs at the plurality of gaming terminals, the new award value being less than the maintained award value of the awarded one of the multiple progressive jackpots for the first player at the first gaming terminal, the maintained award value transitioning to the new award value in response to the first player becoming ineligible for the maintained award value by no longer meeting the predetermined criteria.

10. The gaming-system control module of claim 9, wherein the ineligibility occurs after a certain period of time that the first player plays the wagering game.

11. The gaming-system control module of claim 9, wherein the ineligibility occurs after the first player's play of the wagering game no longer meets the predetermined criteria.

12. The gaming-system control module of claim 1, wherein the base reset value for the awarded one of the multiple progressive jackpots increments to a new award value in response to additional wager inputs, the display for the gaming terminal of the first player displays the maintained award value and the new award value to illustrate the benefit of achieving the predetermined criteria to the first player.

13. The gaming-system control module of claim 1, wherein the at least one controller is further operative to, in response to the first player later triggering the previously awarded one of the multiple jackpots, award the first player an award in the amount of the maintained award value.

14. A method of conducting a wagering game on a gaming system, the wagering game including a base game and a progressive game having multiple progressive jackpots, the method comprising:

receiving wager inputs from players playing the wagering game;

allocating portions of the wager inputs to the progressive game for increasing an award value for each of the multiple jackpots;

determining that a first player has achieved a predetermined criteria while playing the wagering game;

providing an award value of a first one of the multiple progressive jackpots to a second player;

after the determining and the providing, resetting the first one of the multiple progressive jackpots to a base reset value for players other than the first player;

after the determining and the providing, receiving additional wager inputs from players and allocating portions of the additional wager inputs to the progressive game to increment the award values for the multiple jackpots; and after the determining and the providing, maintaining, for the first player, the first one of the multiple progressive jackpots at the award value provided to the second player such that the first player has the opportunity for a higher award relative to other players if the first player triggers the first one of the multiple progressive jackpots.

15. The method of claim 14, further including displaying, on at least one display, values for each of the multiple progressive jackpots.

16. The method of claim 15, wherein each of the wagering games is conducted on a gaming terminal, and the displaying occurs on displays associated with each of the gaming terminals, the gaming terminal of the first player displaying the maintained award value for the first one of the multiple progressive jackpots.

17. The method of claim 14, further including, after the resetting, incrementing the award value of the first one of the multiple progressive jackpots for the other players from the base reset value to a new award value in response to the additional wager inputs, the new award value being less than the maintained award value of the first one of the multiple progressive jackpots for the first player, transitioning the maintained award value to the new award value in response to the first player becoming ineligible for the maintained award value.

18. The method of claim 17, wherein the ineligibility occurs after a certain period of time during which the first player plays the wagering game.

19. The method of claim 17, wherein the ineligibility occurs after the player's play of the wagering game no longer meets the predetermined criteria.

20. The method of claim 14, wherein the predetermined criteria relates wager inputs from the first player.

21. The method of claim 14, further including, after the resetting, incrementing the award value of the first one of the multiple progressive jackpots for the other players from the base reset value to a new award value in response to the additional wager inputs, and transitioning the maintained award value for the first player to the new award value in response to the new award value exceeding the maintained award value.

22. The method of claim 14, further including (i) determining that a third player has achieved the predetermined criteria while playing the wagering game, and (ii) maintaining, for the third player, the first one of the multiple progressive jackpots at the award value provided to the second player such that the first player and the third player have the opportunity for a higher award relative to other players.

23. A method of conducting a wagering game on a gaming system, the wagering game providing access to a progressive game having at least a first progressive jackpot, the method comprising:

receiving, from wager input devices, wager inputs from players playing the wagering game;

incrementing, via the use of at least one controller, the first progressive jackpot to an award value by use of a portion of the wager inputs;

determining, via the use of the at least one controller, that a first player has achieved a predetermined criteria while playing the wagering game;

awarding the award value of the first progressive jackpot to a second player in response to the second player triggering the first progressive jackpot;

after the determining and the awarding, resetting, via the use of the at least one controller, the first progressive jackpot to a base reset value for players other than the first player and maintaining the first progressive jackpot for the first player at the award value awarded to the second player; and after the determining, the awarding, the resetting, and the maintaining, (i) receiving, via the wager input devices, additional wager inputs from players and incrementing the first progressive jackpot from the base reset value to a new award value;

(ii) determining, via the use of the at least one controller, that a third player has achieved the predetermined criteria while playing the wagering game;

(iii) awarding, via the use of the at least one controller, the new award value of the first progressive jackpot to a fourth player in response to the fourth player triggering the first progressive jackpot;

(iv) after the awarding the new award value to the fourth player, resetting, via the use of the at least one controller, the first progressive jackpot to the base reset value for players other than the first player and the third player and maintaining the first progressive jackpot for the third player at the new award value awarded to the fourth player such that the first player and the third player can be awarded different award values relative to other players in response to triggering the first progressive jackpot.

24. The method of claim 23, wherein the maintained award value for the first player and the maintained new award value for the third player are different.

25. The method of claim 23, wherein the progressive game further includes a second progressive jackpot, and the method includes incrementing the second progressive jackpot with a portion of the wager inputs and a portion of the additional wager inputs.

26. The method of claim 23, wherein the gaming system includes a progressive-game controller for controlling aspects of the progressive game and a plurality of gamine terminals, each of the gaming terminals has a gaming-terminal controller, the at least one controller including the gaming-terminal controllers and the progressive-game controller.

* * * * *